US005348293A

United States Patent [19]

Smith

[11] Patent Number: 5,348,293

[45] Date of Patent: Sep. 20, 1994

[54] TETHERED TENNIS GAME

[76] Inventor: Alvin H. Smith, 12542 S. Paramount Blvd., #116, Downey, Calif. 90242

[21] Appl. No.: 197,758

[22] Filed: Feb. 17, 1994

[51] Int. Cl.[5] ..... A63B 61/00

[52] U.S. Cl. ..... 273/29 A; 273/413

[58] Field of Search ..... 273/411, 58 C, 29 A, 273/200 A, 200 B, 319, 30

[56] References Cited

U.S. PATENT DOCUMENTS

| | | | |
|---|---|---|---|
| 2,680,022 | 6/1954 | Walden | 273/200 |
| 2,772,882 | 12/1956 | Anson | 273/29 A |
| 3,086,775 | 4/1963 | Albert | 273/200 |
| 3,809,406 | 5/1974 | Lohr et al. | 273/58 C |
| 3,924,855 | 12/1975 | Pretorius | 273/411 |
| 3,953,028 | 4/1976 | Gowins | 273/58 C |
| 4,342,459 | 8/1982 | Pretorius | 273/411 |
| 4,523,762 | 6/1985 | Garner, Sr. | 273/411 |
| 4,948,137 | 8/1990 | Alverez | 273/411 |

FOREIGN PATENT DOCUMENTS

| | | | |
|---|---|---|---|
| 3416184 | 11/1985 | Fed. Rep. of Germany | 273/411 |
| 876557 | 11/1942 | France | 273/200 A |
| 833350 | 4/1960 | United Kingdom | 273/413 |

*Primary Examiner*—Theatrice Brown

*Attorney, Agent, or Firm*—Edgar W. Averill, Jr.

[57] ABSTRACT

A game for use indoors or out having a pair of vertical posts supporting a net and a horizontal tube extending between the posts a short distance above the net. A sliding assembly is constrained to travel along the tube between two adjustable stops, the assembly having a tethered ball attached thereto. The posts are anchored at their lower ends directly into the ground or are stabilized by weighted feet. The net include elongated pockets for receiving square rods secured at either end in apertures in the posts, the rods holding the net horizontal. The court length can be adjusted by changing the tether length. Further, the type or size of ball can be altered for different levels of difficulty.

5 Claims, 1 Drawing Sheet

TETHERED TENNIS GAME

FIELD OF THE INVENTION

The present invention pertains generally to ball and net games and, more particularly, to an indoor/outdoor tethered-ball net game.

BACKGROUND OF THE INVENTION

Tennis possesses numerous features for casual all the way up to professional-caliber players. As a game, tennis requires skill and strategy as well as quickness and stealth. As a form of excercise, tennis is a thorough aerobic workout requiring a high level of stamina. And as a competitive sport, tennis challenges the fittest athletes and is an extremely popular draw. Despite tennis-'appeal, many are prevented from regularly or even occasionally enjoying the sport as the number of courts is limited. The large area required combined with the high demand for available courts results in an inevitable shortage. Alternative net games, such as paddle ball, have smaller playing areas but still take up a substantial space. Moreover, fast net games using balls such as tennis and paddle ball require some type of perimeter fencing to prevent stray balls from getting lost. Oftentimes, would-be tennis players resort to juggling or hitting against a wall for lack of a proper court, especially in crowded urban areas. Even if there is a surplus of courts, most are out of doors and become unusable during the winter months in colder regions of the country. In these areas, the number of indoor courts is even more scarce with an associated boost in the price of playing.

There have been attempts to design tethered tennis games and practice set-ups to provide a simulated tennis experience in lieu of the real thing. For example, British Patent No. 408,160 shows a tennis practice set-up consisting of a pair of spaced verticle poles supporting a transverse cord secured to a resilient anchorage on either end within the poles. A second cord is slidably mounted to the transverse cord and has a ball secured at the free end. A player drives the ball over a net until the second cord is stretched taut, at which point the resilient anchors exert a return force bringing the ball back over the net for the player to hit again. Unfortunately, this practice game is only designed for use by one person at a time. U.S. Pat. Nos. 3,658,330 and 4,216,960 disclose similar tennis training devices. French Patent No. 39,756 discloses a tethered ball and net game with the ball anchored to a central region of the net. The drawback to this is that the play is artificially focussed around and across the center of the net. Thus, there is a need for a more versatile and accessible net game which overcomes the drawbacks of prior games.

SUMMARY OF THE INVENTION

The present invention provides an indoor/outdoor net game whose playing field can be adjusted easily. The game generally comprises a pair of light-weight verticle posts anchored firmly on the ground. Horizontal rods extend between the posts and through tubular sleeves at the top and bottom edges of a net. A horizontal tube is supported between the posts a slight distance above the net. A ball is attached to a tether affixed to a sliding assembly on the tube. A pair of boundary retraints attached to the tube limits the transverse movement of the sliding assembly on the tube. Players take turns knocking the ball to each other across the net, the sliding assembly allowing the tethered ball to travel completely cross court.

In a preferred form, the upright posts are constructed of light-weight tubular plastic and are anchored at their lower ends with a weighted plateform or, if outdoors, may be driven into the ground to provide anchorage. The transverse rods, net and transverse tube may be provided in a range of sizes, the playing area of the game being adjustable by modifying the spacing between the boundary restraints. Additionally, the longitudinal size of the playing field may be adjusted by changing the length of the tether. Furthermore, the size and weight of both the ball and tether may be adjusted to suit the relative strength and/or needs of different players.

In a preferred form the sliding assembly comprises a plurality of beads interconnected by a loop through central holes in the beads, the connected loop of beads being closed around the tube. The loop of beads is free to rotate and slide transversely along the tube and between the boundary retraints. The tether is attached to one of the beads and thus the action of hitting the ball across the net both rotates and slides the loop of beads on the tube with a minimum of frictional resistance. These and other advantages will become apparant from the following description and accompanying drawing.

DESCRIPTION OF THE PREFERRED EMBODIMENTS

Figures 1, 2:
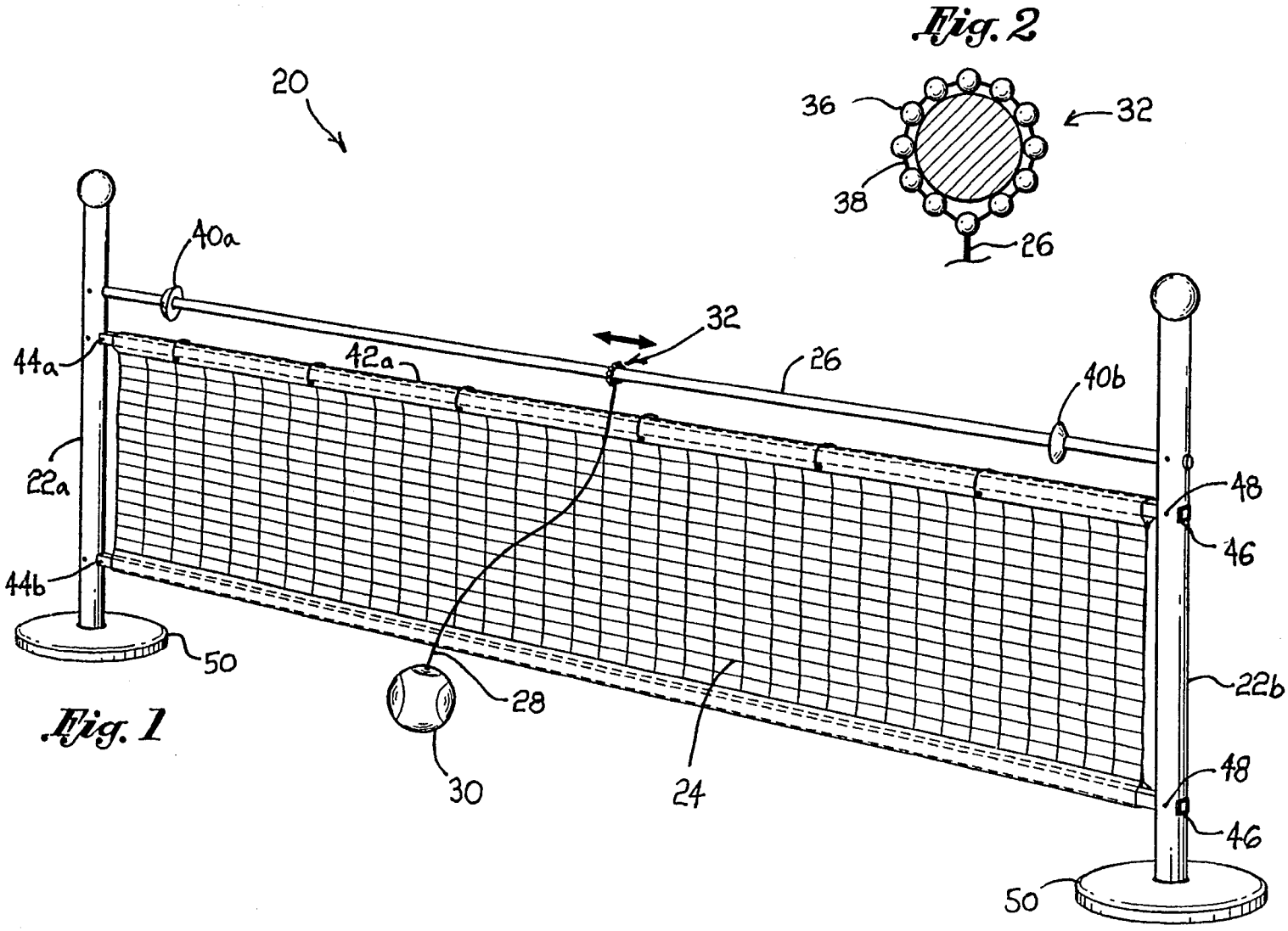
FIG. 1 is a perspective view of one side of the net of the present invention.
FIG. 2 is a partial sectional view showing a looped bead sliding assembly.

Now with reference to FIGS. 1 and 2, the present net game 20 generally comprises a pair of upstanding posts *22a*, *22b* supporting a net 24 strung transversely between the posts, a transverse tubular member 26 and a tether 28 attached to the tubular member and having a ball 30 secured on a free end. The present invention is particularly well suited for simulated tennis games and as such, the ball 30 is preferably a regular tennis ball. However, other types of balls may be substituted depending on the player preference as long as the tether 28 can be securely attached. In the case of tennis balls, the felt cover or nap may be pierced an a small loop at the end of the tether 28 secured thereto with a tight knot. Alternatively, specialized balls having quick-release fasteners built into them may be used, although it is desirable to minimize any additional structure rigidly attached to the ball to reduce alteration of the normal bounce characteristics.

The tether 28 is attached to the tubular member 26 by means of a sliding assembly 32. The sliding assembly 32 allows the tether 28 to rotate about and slide along the tubular member 26 with a minimum of frictional resistance. Although there are certainly many possible arrangements, the preferred form of the sliding assembly 32, as shown in FIG. 2, is a circular array of beads 34 connected by a flexible loop 36 passing through central throughholes (not illustrated). This configuration is simple to assemble, inexpensive and provides an extremely low level of frictional resistance, as the beads essentially act as ball bearings. Indeed, a true ball bearing assembly wherein the tether attaches to an outer race constraining a plurality of free-rotating balls would be ideal for the present invention, yet the embodiment shown is suitable and a substantial reduction in cost. The beads 36 can rotate about their central axes on the loop 38 while sliding at points over the tubular member 26 as the ball 30 travels back and forth over the net 24. The tether 26 is shown attached to one of the beads 36 but may just as easily be attached to the flexible loop 38 at a knot or, alternatively, the loop may be formed at the end of the tether itself.

The tether 28 is preferably constructed of tough inelastic cord or wire, but may take other forms as well. For example, the tether 28 may be elastic to vary the dynamic characteristics of the ball. Additionally, the tether 28 may be of varying lengths in order to change the longitudianl reach of the ball, and thus change the size of the playing court. The flexible loop 38 on the other hand is desirably constructed of inelastic cord or wire and is a set length sufficient to surround the tubular member 26.

A pair of boundary stops or restraints 40*a* and 40*b* fit snugly over the tubular member 26 to limit the transverse movement of the sliding assembly 32. In one embodiment, the restraints 40 comprise frusto-conical sleeves having central bores the same size or slightly smaller than the diameter of the tubular member 26. Thus, the restraints 40 form a frictional or interference fit over the tubular member 26 and are manually slid along the member. Other configurations which enable the restraints 40 to be loosened and repositioned, then tightened once again, are contemplated. Such configurations may include, for example, a band having nut and bolt coupling ends, a quick-release clamp, a suitcase-clasp type fastener, etc. Although there are numerous embodiments, the lateral force exerted on the restraints 40 by the sliding assembly 32 is relatively small and the simple tight fitting sleeve shown is deemed sufficient.

In the sleeve version, the restraints 40 are manually adjusted along the tubular member 26 to vary the transverse span of the game. If the two restraints 40a, 40b are brought together at the center, the game would be limited to shots in a narrow zone near the middle portion of the net. At the other extreme, the restraints 40a, 40b can be widely separated to allow the sliding assembly 32 and attached tethered ball 30 to traverse the entire span of the tubular member 26. Various styles of play can be simulated and particular shots perfected. For instance, to work on a backhand shot, right-handed players would restrict the travel of the sliding assembly 32 to the left half of the tubular member 26. It will now be apparent that the possibilities afforded by the adjustable restraints 40 are limitless. The present invention can be set up practically anywhere given a minimum area. The aforementioned sliding tethered ball 30, tubular member 26 and posts 22 can even be incorporated into a full-sized tennis court. Although not illustrated, the net 24 can be stretched from post-to-post using a cable and winch mechanism, the posts being strong metallic tubes anchored in asphalt. However, the preferred embodiment utilizes lightweight posts anchored at their lower ends with a net supported by rods spanning the posts and attached thereto. This particular arrangement enables the game 20 to be set up as a stand-alone unit and disassembled with ease in practically any location. As seen in FIG. 1, the net 24 includes upper and lower elongated pockets 42*a* and 42*b*, respectively. The pockets 42 receive rigid rods 44*a*, 44*b* whose ends extend into apertures 46 in the vertical posts 22. Pins 48 or a similar expedient secure the rod ends laterally within the apertures 46. The pins 48 may include small locking devices, as with common cotter pins. The posts 22 extend into receptacles in large feet 50 for stability. The posts 22 may be permanently attached to the feet 50, threadingly connected or simply inserted into close fitting receptacles. Once the entire assembly is connected, each component provides a measure of support to one another. In other words, the rigid connection of the posts 22 via the rods 44 works together with the stabilizing feet 50 and weight of the net 24 to maintain the game 20 in an upright stand-alone position during use. The rods 42*a,b* are preferably square tubes which cannot rotate in the square apertures 46, further providing stability by not allowing relative twisting movement, thus ensuring the net 24 14 and posts 22 remain coplanar.

It is preferable to firmly anchor the posts 22 to the ground with additional weight placed on the stabilizing feet 50. Such weight may be in the form of sandbags, rocks or whatever is handy. Alternatively, stakes may be driven through holes (not shown) provided in the feet 50 in lieu of ballast. In soft ground or sand, the posts 22 may be directly planted into the ground without the use of the feet 50. Additionally, the lower ends of the posts 22 may be pointed to facilitate such direct anchoring.

It will now be apparent that the improved net game of the present invention is versatile and simple to set-up. The length of the court may be varied by using different length tethers, while the width can be changed by moving the sliding restraints 40. Finally, the ball 30 may be replaced with another one of different size or dynamic characteristics. All of these modifications combined with the basic construction represent a vast improvement over prior designs.

Although the present invention has been described in terms of certain preferred embodiments, other embodiments are possible and the scope of the invention is to be defined by the following claims.

I claim:

1. A net game, comprising:

a pair of spaced apart vertically extending posts having anchors at their lower ends;

at least one horizontal rod extending between the posts and supporting a net above a support surface;

a horizontal tube supported by the posts above the net;

a tether having a ball firmly attached on a free end and secured to a loop at its other end, said loop being mounted on said tube and being adapted to slide longitudinally along the tube, the ball thus being capable of transversely crossing over the net while said loop slides longitudinally along said tube when said ball is hit.

2. The net game of claim 1, further comprising:

a pair of spaced apart boundary restraints slidably mounted on said tube and capable of longitudinally adjustment along the tube to limit the travel of the loop.

3. The net game of claim 2, wherein said restraints comprise rings having an inside diameter sized slightly smaller than the cross-sectional dimension of said tube and providing a friction fit so that the loop travel span along said tube can be adjusted by moving the rings along said tube.

4. The net game of claim 1, wherein said loop additionally comprises:

a plurality of beads mounted on said loop, said beads being free to rotate on said loop; and wherein one of said beads is a tether connector bead at said tether other end and joining the loop of beads to the tethered ball.

5. The net game of claim 1, wherein each anchor is a weighted base member.

* * * * *